US006852039B2

(12) United States Patent
Pettigrew et al.

(10) Patent No.: US 6,852,039 B2
(45) Date of Patent: Feb. 8, 2005

(54) GOLF BALL WITH TEXTUAL INSTRUCTIONS POSITIONED THEREON

(76) Inventors: Stephen H. Pettigrew, 18640 Castle Lake Dr., Morgan Hill, CA (US) 95037; Victoria I. Pettigrew, 18640 Castle Lake Dr., Morgan Hill, CA (US) 95037

( * ) Notice: Subject to any disclaimer, the term of this patent is extended or adjusted under 35 U.S.C. 154(b) by 0 days.

(21) Appl. No.: 09/808,200

(22) Filed: Mar. 13, 2001

(65) Prior Publication Data

US 2001/0036870 A1 Nov. 1, 2001

Related U.S. Application Data

(63) Continuation of application No. 09/561,199, filed on Apr. 27, 2000.

(51) Int. Cl.[7] ..... A63B 69/36; A63B 37/60; G09F 3/00

(52) U.S. Cl. ..... 473/280; 473/351; 40/327

(58) Field of Search ..... 473/219, 266, 473/351, 280; 40/327

(56) References Cited

U.S. PATENT DOCUMENTS

| | | | | | |
|---|---|---|---|---|---|
| D27,441 | S | * | 7/1897 | Dunn | D21/709 |
| 676,506 | A | * | 6/1901 | Knight et al. | 473/268 |
| 2,035,277 | A | * | 9/1936 | Ryan | 273/125 R |
| 3,081,091 | A | * | 3/1963 | Grow | 473/280 |
| 3,420,529 | A | * | 1/1969 | Goranson et al. | 40/327 |
| 3,563,548 | A | * | 2/1971 | Tolotti | 473/588 |
| 4,345,759 | A | * | 8/1982 | Nims | 40/327 |
| 4,706,958 | A | * | 11/1987 | Inoue | 40/327 |
| 4,874,169 | A | * | 10/1989 | Litchfield | 473/613 |
| 5,133,556 | A | * | 7/1992 | Karasavas | 33/508 |
| 5,564,707 | A | * | 10/1996 | Dinh | 40/327 |
| 5,662,530 | A | * | 9/1997 | Sellar | 473/268 |
| 5,704,846 | A | * | 1/1998 | Johnson | 473/214 |
| 5,713,799 | A | * | 2/1998 | Balmat | 40/327 |
| D407,451 | S | * | 3/1999 | Disco | D21/708 |
| D408,481 | S | * | 4/1999 | Disco | D21/708 |
| 6,231,459 | B1 | * | 5/2001 | Pettigrew et al. | 473/219 |

FOREIGN PATENT DOCUMENTS

| | | | | | |
|---|---|---|---|---|---|
| GB | 2083365 | A | * | 3/1982 | A63B/37/14 |

* cited by examiner

*Primary Examiner*—Gregory Vidovich
*Assistant Examiner*—Alvin A. Hunter, Jr.
(74) *Attorney, Agent, or Firm*—Zilka-Kotab, PC

(57) ABSTRACT

The present invention includes an instructional golf ball including a spherical body having an outer surface with a plurality of dimples formed therein. Situated on the outer surface of the body is instructional indicia. Such instructional indicia include text for providing guidance as to the manner in which a user should play the golf ball. During use, a user might read the instructional indicia while addressing the golf ball, and address and/or strike the golf ball in the manner indicated by the instructional indicia.

4 Claims, 3 Drawing Sheets

GOLF BALL WITH TEXTUAL INSTRUCTIONS POSITIONED THEREON

This is a continuation of Application No. 09/561,199, filed Apr. 27, 2000.

FIELD OF THE INVENTION

The present invention relates to the game of golf, and more particularly to improving the golf game of a user using instructional indicia positioned on golf balls.

BACKGROUND OF THE INVENTION

Much effort has been made in the history of golf to improve the manner in which golfers perform during the game. Numerous devices and techniques have been developed during such effort. In particular, many techniques have been established that allow a golfer to address and strike a golf ball more effectively. For example, it is preferred that a head of a golfer is kept down when striking a golf ball, the golf ball is struck in a certain area when putting and driving, etc. Normally, these techniques are conveyed by way of videos, instructional manuals, and even by word of mouth.

A number of attempts have been made to aid the golfer in implementing the foregoing techniques. Often, such attempts involve the positioning of indicia or markings on the golf ball. Examples of such indicia are shown in patents issued to Knight, Devries, Faynes, Yamamoto, Chen, Mook, and Dinh. Each of these prior art inventions, though good, are deficient in that the marking, by themselves, are often abstract and difficult to utilize without an instruction manual or the like.

U.S. Pat. No. 676,506 to Knight provides a plurality of intersecting lines or stripes around the great circle of the ball which provides a focal point (at point of circumferential intersection) for a golfer to focus his swing and target. In playing the ball, the golfer places one of the intersecting points such that the spot at the intersection is just visible at the back of the ball. This will appear to the golfer to be a v-shaped spot at the back of the ball. The v-shaped spot is aligned with the intended target suggesting where and in what direction the ball should be struck.

U.S. Pat. No. 2,709,595 to DeVries describes a ball having a narrow stripe of contrasting color around the ball's middle (great circle or equatorial circle) for use in putting. This ball is positioned such that the stripe is in line with its intended direction of travel. If a ball is so positioned and is properly putted, the width of the stripe will not increase in appearance as it rolls. If the ball is improperly putted, the apparent width of the stripe will increase in an amount corresponding to the angle of deviation from the line of travel. DeVries further teaches that it is essential that the stripe be relatively narrow in relation to the diameter of the ball or else the illusion of widening will be lost.

U.S. Pat. No. 3,325,168 to Faynes is a training device for driving which includes a ball with diametrically opposed markings on the relative front and back of a ball establishing a diameter through the center of the ball. The ball is of penetrable material and is struck with a club having a protruding needle. The purpose is to strike the ball with the club such that the needle penetrates the respective front and back markings along the established diameter.

U.S. Pat. No. 4,209,172 to Yamamoto discloses a putting training device including a putter and a ball; the ball having two equatorial lines perpendicular to one another encircling the ball with corresponding alignment lines on the putter.

The purpose is to align the respective lines and smoothly stroke the ball following that alignment.

U.S. Pat. No. 4,441,716 to Chen discloses a golf ball practice aid having grid markings thereon and colored sectional regions on the face of a club to help a golfer determine the exact dimensional orientation of the club face at the moment the ball practice aid is struck. The grid bears a marking conveyed by the club after the ball practice aid has been struck.

U.S. Pat. No. 5,067,719 to Mook discloses a golf ball having three mutually perpendicular equatorial circles; each of a different, primarily, primary color of red, blue, and yellow. At the locations where the circles meet, they do not intersect or overlap, but leave a blank area. The broken circles at these locations point toward each other. The purpose of this ball is to determine the amount and type of spin communicated to the ball after it is struck by color changes detected on the ball in flight and to make corrections to alignment and swing thereby. One of the locations (relative top) is a focal point for a golfer to concentrate when swinging; and another such location (relative back) is the sweet spot where the ball should be struck. The three circles are also used minimally for alignment of the ball to the club and to the target.

U.S. Pat. No. 5,564,707 to Dinh teaches a golf ball and method which includes providing a number of indicators for properly aligning a golf ball, a golfer and a golf club relative to an intended path of travel. The indicators include a ball-travel indicator for alignment with the intended path, a ball-to-ground indicator for positioning the golf ball in relation to the surface on which the ball is positioned, a foot-to-ball indicator for aligning the golfer, and a putter-alignment indicator for properly positioning a striking face of the golf club. In the preferred embodiment, the indicators are stenciled onto the golf ball.

Each of these prior art inventions provide a golf ball or practice aid with abstract indicia for the purpose of improving the manner in which the golf ball is addressed and struck. Such markings in and of themselves, however, do not explain how to utilize the markings, nor offer any additional advice in terms of addressing and striking the ball. The user must therefore refer to an instructional manual or seek advice from an instructor As such, the golf balls with indicia of the prior art essentially lack utility without accompanying documentation or an instructor.

There is thus a need for golf balls that provide guidance as to the manner in which a golf ball is to be addressed and struck without requiring reference to manuals or the like.

DISCLOSURE OF THE INVENTION

The present invention includes an instructional golf ball including a spherical body having an outer surface with a plurality of dimples formed therein. Situated on the outer surface of the body is instructional indicia. Such instructional indicia include text for providing guidance as to the manner in which a user should play the golf ball during practice or a game. In use, a user might read the instructional indicia while addressing the golf ball, and address and/or strike the golf ball in the manner indicated by the instructional indicia.

In one embodiment of the present invention, the instructional indicia is intended to aid the user in putting the golf ball. In such embodiment, a pair of spaced bands flank an equator of the body of the golf ball. Further, a putt target marking is situated on the equator of the body between the bands. During use, the putt target marking is adapted for indicating a point on the golf ball to be struck when putting, and the bands indicate any spin associated with the golf ball.

In another embodiment of the present invention, the instructional indicia is intended to aid the user in driving the golf ball. Accordingly, a tee marking is situated on the body of the golf ball, and a drive target marking is situated in a hemisphere of the body of the golf ball in which the tee marking is situated. In operation, the tee marking is adapted for indicating a point on the golf ball to be positioned on a tee when driving, and the drive target marking is adapted for indicating a point on the golf ball to be struck.

As an option, feet indicia indicative of feet of the user might be situated on the outer surface of the body. The feet indicia illustrate a proper positioning of the feet of the user in accordance with the text. In addition, arrow indicia might be positioned on the body of the golf ball. Upon positioning the golf ball such that the arrow indicia is situated at an apex of the golf ball and is directed in an intended direction of motion of the golf ball, the text is visible to a user addressing the golf ball.

These and other advantages of the present invention will become apparent upon reading the following detailed description and studying the various figures of the drawings.

BRIEF DESCRIPTION OF THE DRAWINGS

The foregoing and other aspects and advantages are better understood from the following detailed description of a preferred embodiment of the invention with reference to the drawings, in which.

DESCRIPTION OF THE PREFERRED EMBODIMENTS

FIGS. 1A–3D illustrate a plurality of golf balls 100 of the present invention each of which has instructional indicia 102 situated thereon. As shown, the golf balls 100 each include a substantially rigid spherical body 104 having an outer surface. Such outer surface is equipped with a plurality of semi-spherical dimples 106 formed therein in an equally spaced, symmetric configuration. It should be noted that the various golf balls 100 of FIGS. 1A–3D might be provided in combination or separately per the desires of the user.

Figure 1A:
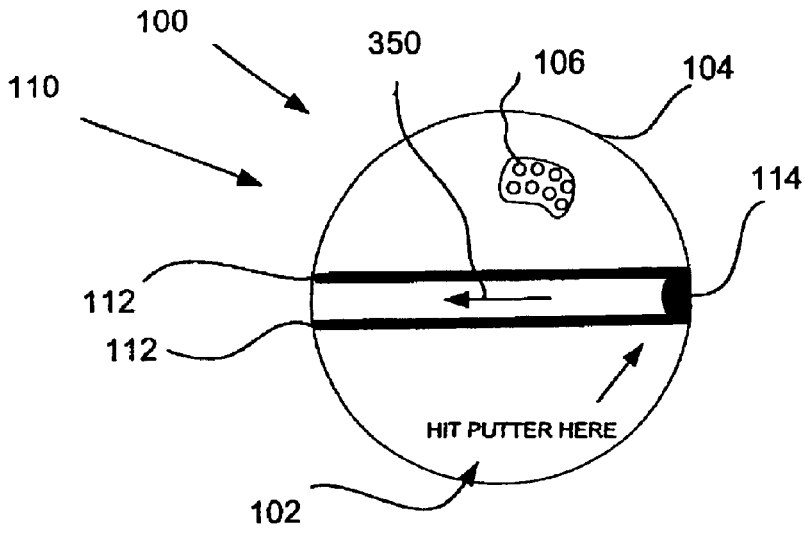
FIG. 1A is a top view of a putt golf ball in accordance with one embodiment of the present invention.
Figure 1B:
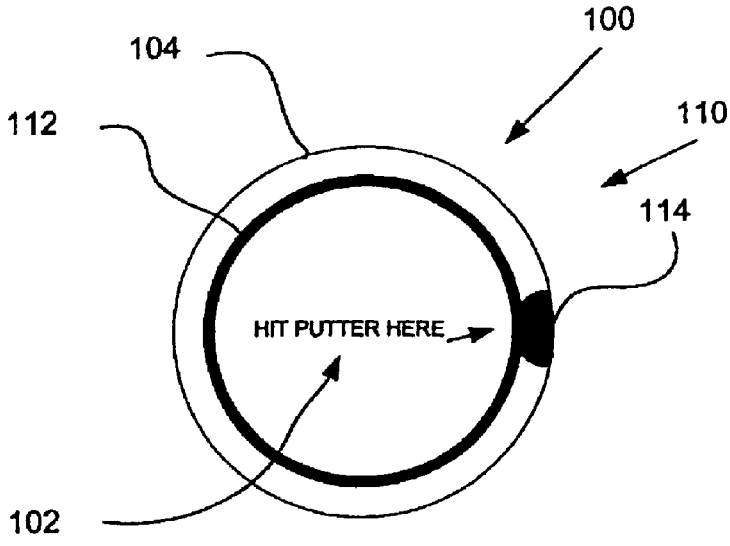
FIG. 1B is a bottom view of the putt golf ball of FIG. 1A in accordance with one embodiment of the present invention.

FIGS. 1A and 1B are top and side views of a putt golf ball 110 of the present invention, respectively. As an option, the putt golf ball 110 may have a first color which is differentiable with respect to the remaining golf balls. As best shown in FIG. 1A, the putt golf ball 110 has a pair of spaced bands 112 flanking an equator of the body 104. Such bands 112 have an equal diameter and are spaced an equal distance from the equator of the body 104. In an alternate embodiment, hemispheres of the body 104 defined by the bands 112 may be colored, and a space between the bands 112 may be colorless or have a different color, thus enhancing the affect of the bands 112 during use. As an option, the bands 112 may be removed all together in such embodiment.

In addition to the bands 112, a substantially circular putt target marking 114 is situated on the equator of the body 104 between the bands 112. Such putt target marking 114 is equipped with a width no greater than a width of a space defined between the bands 112. Also included is putting instructional indicia 102 including text. In one embodiment, the text might state "HIT PUTTER HERE" with an arrow directed towards the putt target marking 114. It should be noted that the putting instructional indicia 102 might take the form of any other text that explains the use of the putt target marking 114 and/or the bands 112, or general putting information. Optionally, the putting instructional indicia 102 may be positioned on an upper hemisphere of the putt golf ball 110 for visibility purposes.

In use, the putt target marking 114 is adapted for indicating a point on the putt golf ball 110 to be struck when putting, as signified by the putting instructional indicia 102. After the putt golf ball 110 has been struck, the bands 112 indicate any spin associated with the putt golf ball 110.

Figure 2A:
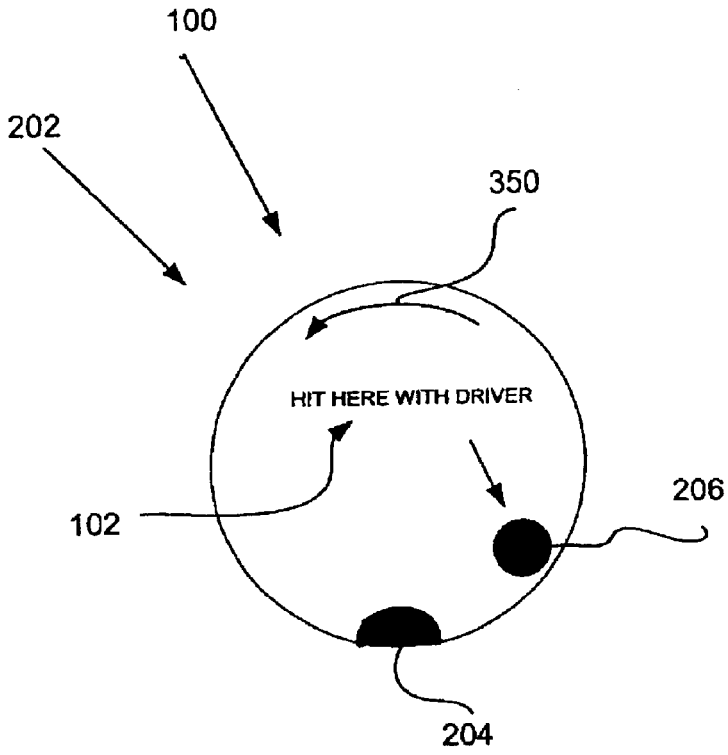
FIG. 2A is a side view of a drive golf ball in accordance with one embodiment of the present invention.
Figure 2B:
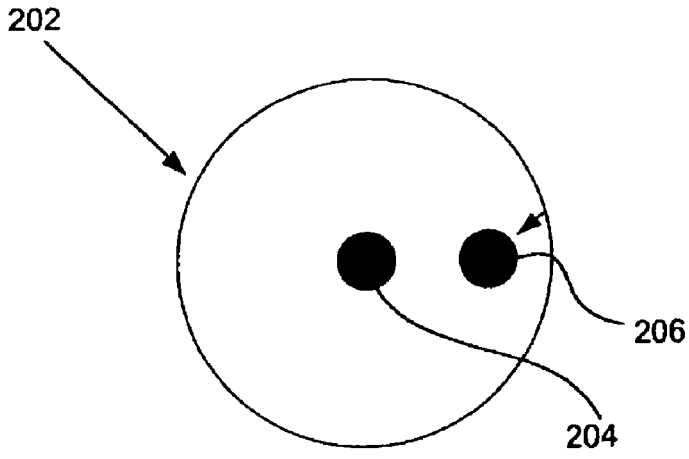
FIG. 2B is a bottom view of the drive golf ball of FIG. 2A in accordance with one embodiment of the present invention.
Figure 3A:
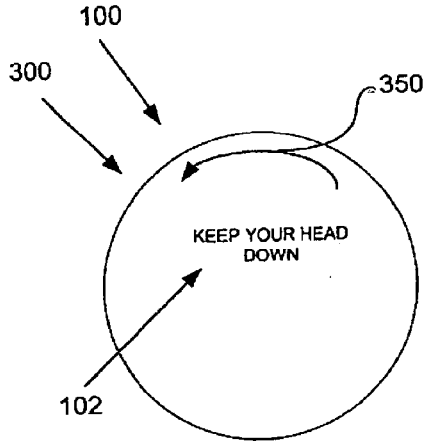
FIGS. 3A is a top view of one of the general instructional golf balls of the present invention which indicates "KEEP YOUR HEAD DOWN" in accordance with one embodiment of the present invention.
Figure 3B:
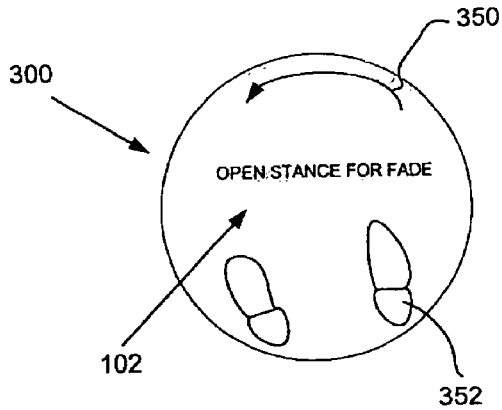
FIGS. 3B is a top view of one of the general instructional golf balls of the present invention which indicates "OPEN STANCE FOR A FADE" in accordance with one embodiment of the present invention.
Figure 3C:
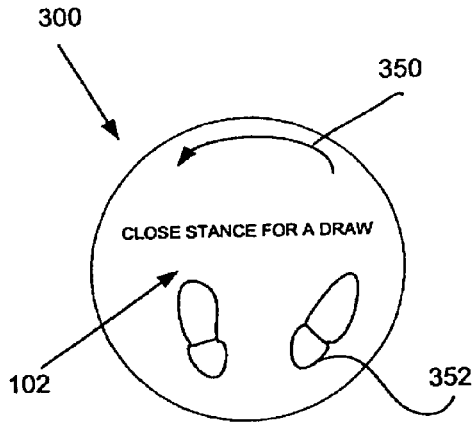
FIGS. 3C is a top view of one of the general instructional golf balls of the present invention which indicates "CLOSE STANCE FOR A DRAW" in accordance with one embodiment of the present invention.
Figure 3D:
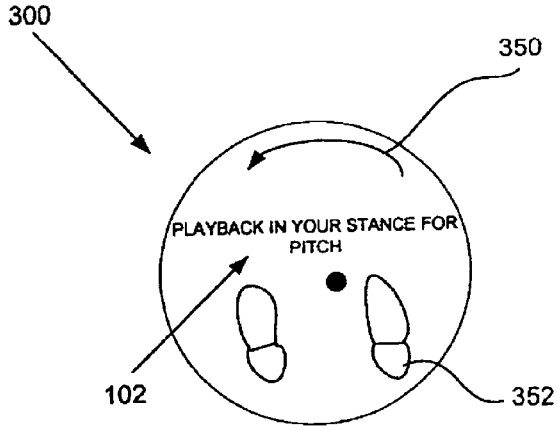
FIGS. 3D is a top view of one of the general instructional golf balls of the present invention which indicates "PLAY-BACK IN YOUR STANCE FOR PITCH" in accordance with one embodiment of the present invention.

FIGS. 2A and 2B are side and bottom views of a drive golf ball 202 of the present invention, respectively. Similar to the putt golf ball 110 of FIGS. 1A and 1B, the drive golf ball 202 might exhibit a second color which is differentiable with respect to the remaining golf balls.

As best shown in FIG. 2B, a substantially circular tee marking 204 is situated on the body of the drive golf ball 202. Further, a substantially circular drive target marking 206 is situated in a hemisphere of the body of the drive golf ball 202 in which the tee marking 204 is situated. In one embodiment, the drive target marking 206 forms an angle of between 30 and 60 degrees with a center of the body of the drive golf ball 202 and the tee marking 204.

The drive golf ball 202 is equipped with driving instructional indicia 102 including text that identifies the drive target marking 206 as where the user should strike the drive golf ball 202 while driving. In one embodiment, the text might state "HIT HERE WITH DRIVER" with an arrow directed towards the drive target marking 206. It should be noted that the driving instructional indicia 102 might take the form of any other text that explains the use of drive target marking 206 and/or tee marking 204, or general driving information. Optionally, the driving instructional indicia 102 may be positioned on an upper hemisphere of the drive golf ball 202 for visibility purposes.

In use, the tee marking 204 is adapted for indicating a point on the drive golf ball 202 to be positioned on a tee when driving. Further, the drive target marking 206 is adapted for indicating a point on the drive golf ball 202 to be struck, as signified by the driving instructional indicia 102.

With reference now to FIGS. 3A–3D, the golf balls 100 are shown to include a plurality of general instruction golf balls 300 having different colors, and each having general instructional indicia 102. Such general instructional indicia 102 includes text including, but not limited to "KEEP YOUR HEAD DOWN", "OPEN STANCE FOR A FADE", "CLOSE STANCE FOR A DRAW", "PLAYBACK IN YOUR STANCE FOR PITCH," etc. Note FIGS. 3A, 3B, 3C and 3D, respectively. Further examples include "FLEX KNEES", "WATCH BALL", "WAGGLE", "READ THE BREAK", "SPEED KILLS", "WARM UP", "STEADY HEAD", "ALWAYS TEE-UP", etc. It should be noted that the text might include any text that relates to instructing a golfer regarding the play of golf.

In various alternate embodiments, the instructional indicia 102 may include text that falls within various categories all of which instruct a golfer regarding the play of golf. For example, such categories may include a fun category, a "swing thoughts" category, an etiquette category, or any other category. Examples of text within the fun category may include "FORE", "BE POSITIVE", "KEEP SENSE OF HUMOR", "HAVE FUN", "TAKE LESSONS", "ONLY BET WHAT YOU CAN LOSE", "NEVER GIVE UP", "DO NOT GIVE YOUR SPOUSE LESSONS", etc. Examples of text within the "swing thoughts" category may include "FOLLOW THROUGH", "SWING SMOOTHLY", "BE POSITIVE", etc. Examples of text within the etiquette category may include "BE HONEST", "DO NOT MOAN", "BUNKERS, NOT STANDTRAPS", "PLAY QUICKLY", "PLAY READY GOLF" etc.

In addition to the text, feet indicia 352 indicative of feet of the user might be situated on the outer surface of the body. The feet indicia 352 illustrates a proper positioning of the feet of the user in accordance with the text. Further indicia may also be included which indicates a proper location of a ball with respect to the feet of the user. Note FIG. 3D.

As shown in FIGS. 1A–3D, the golf balls of the present invention each include arrow indicia 350 positioned thereon. Upon positioning the golf ball such that the arrow indicia 350 is situated at an apex of the golf ball and directed in an intended direction of motion of the golf ball, the instructional indicia 102 is visible to a user addressing the golf ball. This ensures that the instructional indicia 102 are readily observable, and feasibly read from right to left when addressing the golf ball.

In one example of use, a user may select one of the golf balls 100 of the present invention based on whether the user is putting, driving, etc. In the alternative, the user may simply select one of the general instruction golf balls 300. In the present example wherein the user is putting, the putt golf ball 110 is selected. The putt golf ball 110 is first situated on the green such that the arrow indicia 350 is positioned at an apex of the putt golf ball 110 and directed in an intended direction of motion, i.e. towards the hole or along a target line to account for any break in the putting surface.

With the arrow indicia 350 in such position, the putting instructional indicia 102 is clearly readable from left to right while the user addresses the putt golf ball 110. It should be noted that the putting instructional indicia 102 may also be read prior to positioning the putt golf ball 110 on the green. The putting instructional indicia 102 are thus readily apparent and act as a reminder at the instant when it matters the most, during the putt.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. An instructional golf ball, comprising:

a spherical body having an outer surface with a plurality of dimples formed thereon; instructional indicia situated on the outer surface of the body, the instructional indicia including the text to indicate that the putt target marking is the point on the golf ball to be struck when putting; and positioning indicia situated on the outer surface of the body in specific relation to the instructional indicia for facilitating the placement of the body prior to being played such that the instructional indicia is easily read; wherein the specific relation of the positioning of the instructional indicia and the positioning indicia ensures that the instructional indicia is capable of being read from left to right by a user addressing the golf ball when the positioning indicia is positioned at an apex of the golf ball and directed in a direction of a target, thereby providing an instructional reminder while the user addresses the golf ball; wherein a pair of spaced bands flank an equator of the body of the golf ball, and a putt target marking is situated on the equator of the body between the bands, wherein the putt target marking is adapted for indicating a point on the golf ball to be struck when putting, and the bands indicate any spin associated with the golf ball when putting, wherein the text indicates that the putt target marking is the point on the golf ball to be struck when putting.

2. An instructional golf ball, comprising:

a spherical body having an outer surface with a plurality of dimples formed thereon; instructional indicia situated on the outer surface of the body, the instructional indicia including text for providing guidance as to the manner in which the golf ball should be played, and positioning indicia situated on the outer surface of the body in specific relation to the instructional indicia for facilitating the placement of the body prior to being played such that the instructional indicia is easily read; wherein the specific relation of the positioning of the instructional indicia and the positioning indicia ensures that the instructional indicia is capable of being read from left to right by a user addressing the golf ball when the positioning indicia is positioned at an apex of the golf ball and directed in a direction of a target, thereby providing an instructional reminder while the user addresses the golf ball; wherein a drive target marking is situated on the body of the golf ball, wherein the drive target marking is adapted for indicating a point on the golf ball to be struck when driving; wherein a tee marking is situated on the body of the golf ball, wherein the tee marking is adapted for indicating a point on the golf ball to be positioned on a tee when driving, and wherein the text indicates that the drive target marking is the point on the golf ball to be struck.

3. A method of improving the manner in which a golf ball is played by a user during golf, comprising:

placing a golf ball on a ground surface, the golf ball including a spherical body having an outer surface with a plurality of dimples formed thereon; reading instructional indicia situated on the outer surface of the body, wherein the instructional indicia includes text for providing guidance as to the manner in which the golf ball should be played by a user; and playing the golf ball in the manner indicated by the instructional indicia, wherein positioning indicia is situated on the outer surface of the body in specific relation to the instructional indicia for facilitating the placement of the body prior to being played such that the instructional indicia is easily read by the user, the specific relation of the positioning of the instructional indicia and the positioning indicia ensuring that the instructional indicia is capable of being read from left to right by the user addressing the golf ball when the positioning indicia is positioned at an apex of the golf ball and directed in a direction of a target, thereby providing an instructional reminder while the user addresses the golf ball; wherein a pair of spaced bands flank an equator of the body of the golf ball, and a putt target marking is situated on the equator of the body between the bands, and further comprising using the putting, and the using the bands to detect any spin associated with the golf ball when putting, and wherein the text indicates that the putt target marking is the point on the golf ball to be struck when putting.

4. A method of improving the manner in which a golf ball is played by a user during golf, comprising:

placing a golf ball on a ground surface, the golf ball including a spherical body having an outer surface with a plurality of dimples formed thereon; reading instructional indicia situated on the outer surface of the body, wherein the instructional indicia includes text for providing guidance ms to the manner in which the golf ball should be played by a user; and playing the golf ball in the manner indicated by the instructional indicia, wherein positioning indicia is situated on the outer surface of the body in specific relation to the instructional indicia for facilitating the placement of the body prior to being played such that the instructional indicia is easily read by the user, the specific relation of the positioning of the instructional indicia and the positioning indicia ensuring that the instructional indicia is capable of being read from left to right by the user addressing the golf ball when the positioning indicia is positioned at an apex of the golf ball and directed in a direction of a target, thereby providing an instructional reminder while the user addresses the golf ball; wherein a drive target marking is situated on the body of the golf ball, and further comprising using the drive target marking to determine a point on the golf ball to be struck when driving; wherein a tee marking is situated on the body of the golf ball, and further comprising using the tee marking to determine a point on the golf ball to be positioned on a tee when driving, and wherein the text indicates that the drive target marking is the point on the golf ball to be struck when driving.

* * * * *

UNITED STATES PATENT AND TRADEMARK OFFICE

CERTIFICATE OF CORRECTION

PATENT NO. : 6,852,039 B2
APPLICATION NO. : 09/808200
DATED : February 8, 2005
INVENTOR(S) : Pettigrew et al.

It is certified that error appears in the above-identified patent and that said Letters Patent is hereby corrected as shown below:

Col. 8, line 2, please replace “ms” with --as--.

Signed and Sealed this
Thirty-first Day of May, 2011

David J. Kappos

David J. Kappos
*Director of the United States Patent and Trademark Office*